US006412262B2

(12) United States Patent
Ragnoli et al.

(10) Patent No.: US 6,412,262 B2
(45) Date of Patent: Jul. 2, 2002

(54) DEVICE AND PROCESS FOR THE SPLICING OF TEXTILE THREADS USING COMPRESSED AIR AND LIQUID

(75) Inventors: Fabrizio Ragnoli, Roe' Volciano; Valentino Crescini, Gavardo, both of (IT)

(73) Assignee: Mesdan S.p.A., Salo' (IT)

( * ) Notice: Subject to any disclaimer, the term of this patent is extended or adjusted under 35 U.S.C. 154(b) by 0 days.

(21) Appl. No.: 09/775,980

(22) Filed: Feb. 2, 2001

(30) Foreign Application Priority Data

Feb. 15, 2000 (IT) ..... MI00A0250

(51) Int. Cl.[7] ..... D01H 15/00
(52) U.S. Cl. ..... 57/22; 57/23
(58) Field of Search ..... 57/22, 23, 350, 57/261, 263, 202, 1 UN; 28/271, 274, 141, 209, 210, 272; 156/49

(56) References Cited

U.S. PATENT DOCUMENTS 4,229,935 A * 10/1980 Wain ..... 57/22
4,263,775 A * 4/1981 Mima ..... 242/475.1
4,411,128 A * 10/1983 Mima ..... 242/475.1
4,555,899 A * 12/1985 Mima ..... 57/22
4,566,260 A * 1/1986 Irmen ..... 57/22
RE32,372 E * 3/1987 Rohner ..... 57/22
5,052,172 A * 10/1991 Matsui et al. ..... 57/1 UN
5,406,781 A * 4/1995 Yokoya ..... 57/1 UN
6,170,247 B1 * 1/2001 Ragnoli et al. ..... 57/22

* cited by examiner

*Primary Examiner*—Amy B. Vanatta
(74) *Attorney, Agent, or Firm*—Hedman & Costigan, P.C.

(57) ABSTRACT

A device (10, 10') for the splicing of textile threads using compressed air and liquid, which includes a casing on which is assembled a splicing head in which is made a mixing chamber (11), at least one feed duct of air with added liquid which leads into the chamber (11), a valve which is controlled by the immission of compressed air and means to add the liquid to the compressed air before its immission into the chamber (11). The splicing head, with its chamber, is set in an isolated tank from which extends at least one channel for the discharge to the outside of the compressed air with added liquid device. The device (10, 10') has means for creating suction in the water discharge channel or channels (15, 16, 22, 23). In addition, the object of the present invention is a process for the splicing of textile threads using compressed air and liquid.

8 Claims, 6 Drawing Sheets

DEVICE AND PROCESS FOR THE SPLICING OF TEXTILE THREADS USING COMPRESSED AIR AND LIQUID

The object of the present invention is a device and process for splicing textile threads using compressed air and liquid.

Compressed air devices for splicing textile threads are known (also known as splicers), both manually and mechanically operated, the latter being used chiefly on automatic spoolers.

In some cases, when required by the fibres and/or the characteristics of the yarns to be processed (e.g. in the case of linen or multi-cotton yarns) it is advantageous to add a certain amount of liquid (usually water) to the compressed air to increase splice resistance and improve its appearance. Such technology is shown for instance in the U.S. Pat. No. 3,407,583, U.S. Pat. No. 3,274,764 and U.S. Pat. No. 3,458,905.

The main drawback of these solutions is that the liquid, with the compressed air injected into the area where splicing takes place, runs over the splicer and machine parts nearby, causing serious maintenance problems, which are aggravated by dust in the textile environment, (particularly by fibres) in the air.

A solution to this problem is described in the Italian patent IT 1223431; in this solution the mixing chamber is set in a tank which is hermetically sealable, before or during the splicing operation.

Although having proved itself extremely effective, this solution has additional drawbacks, the biggest of which is the fact that the thread ends to be spliced must be well within the aforesaid tank when it is closed; otherwise even if just one end was held back, the splice would be prevented or, in any case, would be very weak, also resulting in at least one thread end protruding from the same.

Unfortunately the length of the thread ends is not always easily to verify after the preparation stage: this means a detwisting of the fibres which make up the threads and the detachment of some of these fibres which, sometimes, only partially occurs lengthening, in any case, the thread ends to be inserted in the tank.

Another drawback is that the pressure created in the tank, at the moment of immission of the splicing air jet into the mixing chamber, can disturb the normal air flow from the same and prevent correct splicing of the ends, with a consequent worsening in both appearance and resistance.

A further drawback is that the pressure created in the tank, at the moment of immission of the compressed air into the mixing chamber, tends to strain the hermetic seal of the tank, thus allowing water and air to escape.

The aim of the present invention is therefore to produce a device and a process for splicing textile threads using compressed air and liquid which solves the aforesaid problems, obtaining a high quality splice, both in terms of resistance and appearance.

These and other aims are reached by a device for the splicing of textile threads using compressed air and liquid, according to claim 1, to which reference is made for the sake of brevity.

In addition, the object of the present invention is a process for splicing textile threads using compressed air and liquid, according to claim 8.

Moreover, further characteristics of the present invention are defined in the other claims.

Further aims and advantages of the present invention will become apparent from the description that follows and from the enclosed drawings, supplied simply as explanatory, non-limiting examples, in which.

Figure 1:
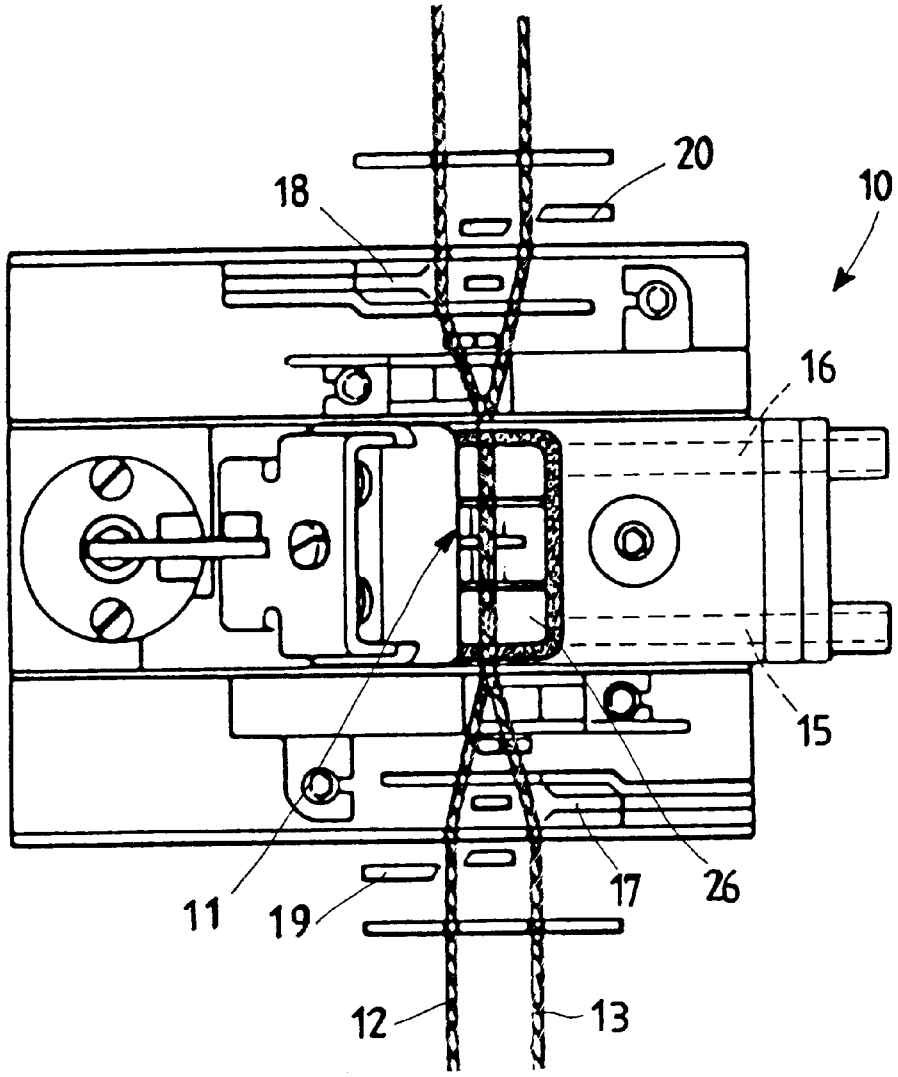
FIG. 1 is a schematic view of the stage of thread introduction into a splicing device, according to the present invention.
Figure 2:
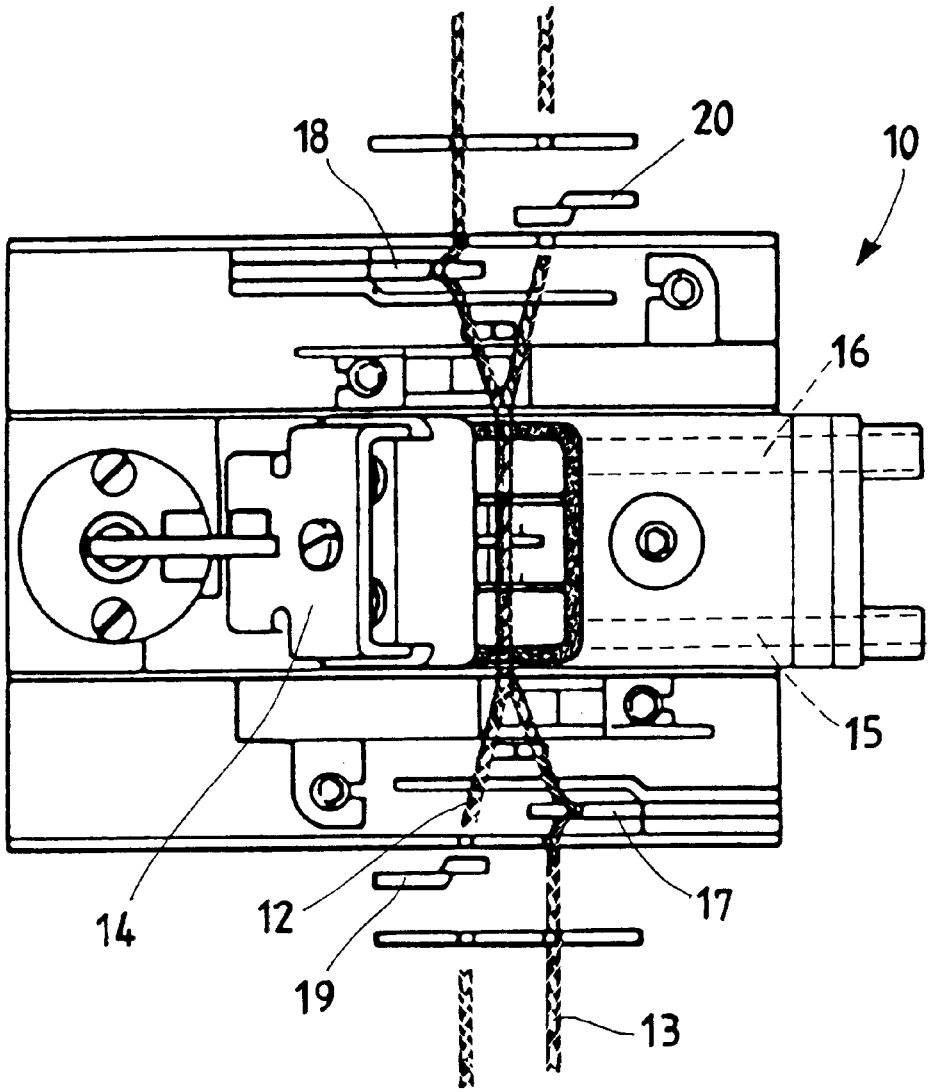
FIG. 2 is a schematic view of the clamping and cutting stage of threads in the splicing device in FIG. 1.

With particular reference to FIGS. 1-5, the device for splicing textile threads, according to a first embodiment of the invention is denoted, as a whole, by reference number 10. The device 10 can be used on an automatic spooler.

A detailed description of the known device parts is not given here, as it is already described in Italian patent IT 1223431, to which express reference is made, therefore only the useful functional elements are quoted for the interpretation and implementation of the invention.

In wholly concise terms, the device 10 includes a casing on which a splicing head is assembled in which a mixing chamber 11 is made, inside of which the splicing of two threads or yarns 12 and 13 takes place.

The mixing chamber 11 is set in a tank 26, hermetically sealable before or during the splicing operation by means of a cover 14. At least one feed duct of air with added liquid comes out from the mixing chamber 11 (not shown for simplicity). Water discharge channels are also present 15 and 16, whose function will be better shown afterwards. There are also clamps 17 and 18 and scissors 19 and 20 to cut the threads 12 and 13.

The operation of the device for splicing textile threads, using compressed air and liquid, is briefly shown later on in the present description.

FIG. 1 shows the threads 12 and 13 to be spliced while they are introduced into the device 10.

Afterwards (FIG. 2) the clamping and cutting of the threads 12 and 13 is carried out, by means of the clamps 17 and 18 and scissors 19 and 20 and the partial closing of the tank 26.

Figure 3:
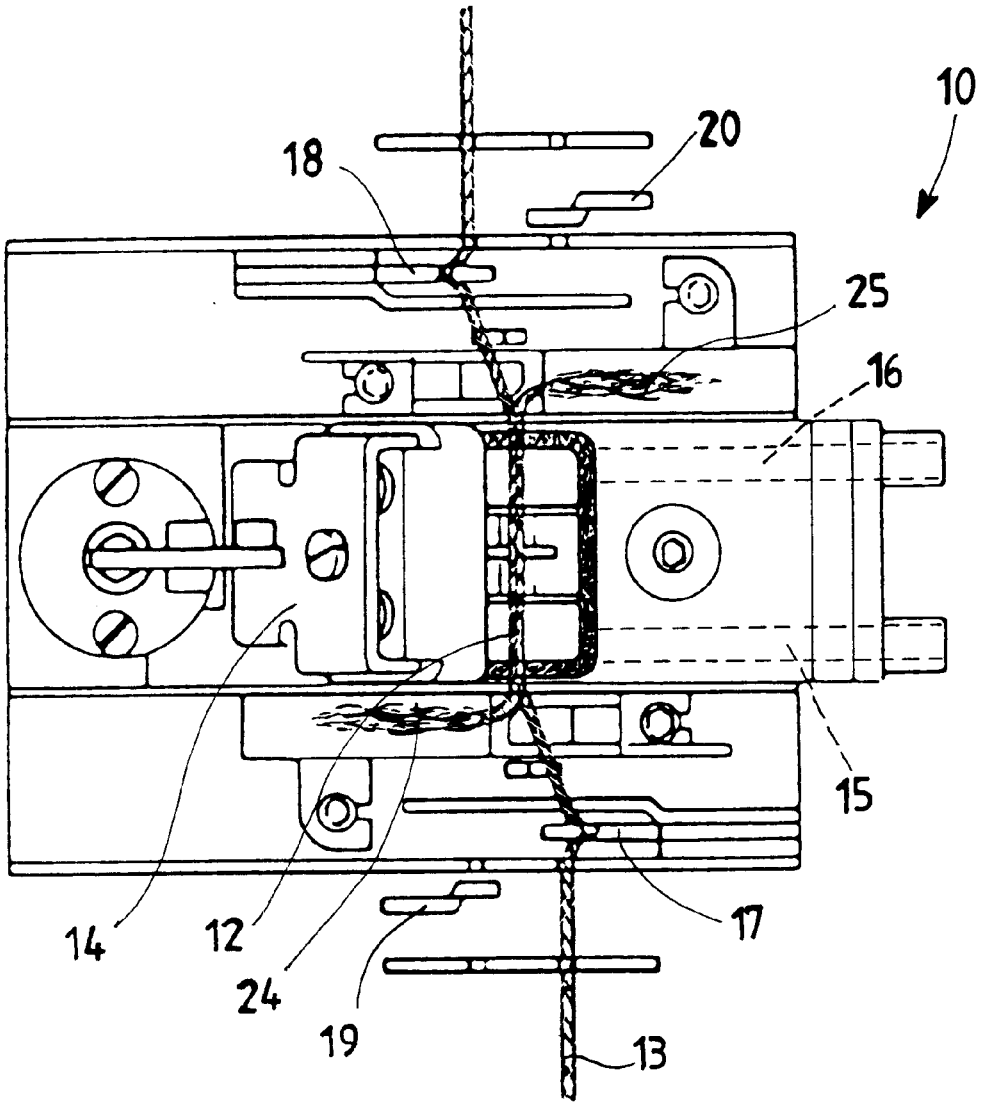
FIG. 3 is a schematic view of a detwisting stage of the thread ends to be spliced in the splicing device in FIG. 1.
Figure 4:
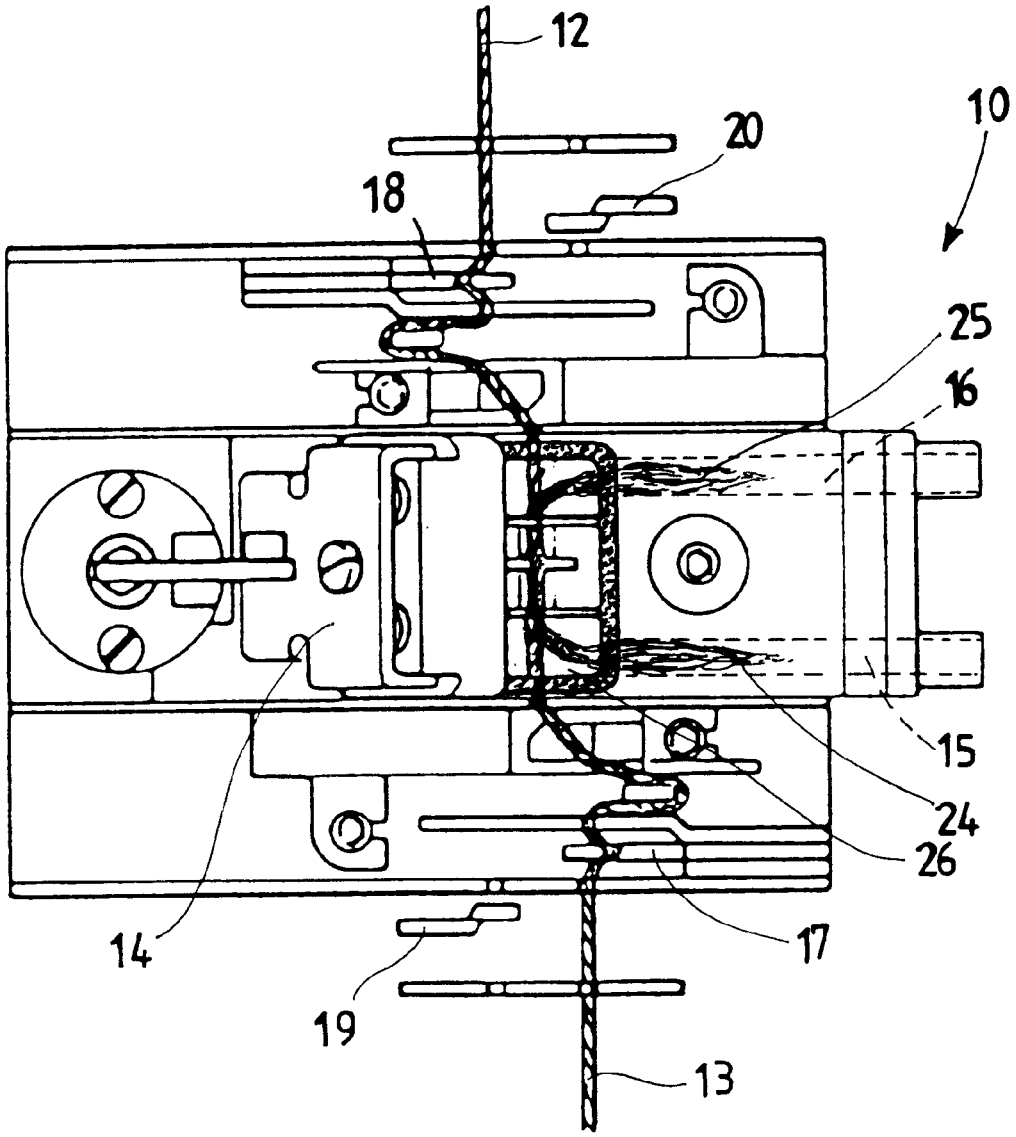
FIG. 4 is a schematic view of a stage of keeping in place through suction of thread ends to be spliced in the splicing device in FIG. 1.

FIG. 3 shows a schematic view of a treatment (or detwisting) stage of thread ends 12 and 13, denoted by numbers 24 and 25, which is normally followed by a partial withdrawal stage of ends 24 and 25.

In consequence of this stage, if the invention device were not applied, the complete closure of the tank 26 by means of cover 14, partially holding back the ends 24 and 25 would or could happen.

The present invention avoids this phenomenon by putting the water discharge channels 15 and 16 from the tank 26 under suction pressure upon the hermetic sealing of the tank 26. In this way, the ends 24 and 25 are drawn towards the water discharge channels 15 and 16 and therefore cannot be held back by the cover 14 when it is closed.

Figure 5:
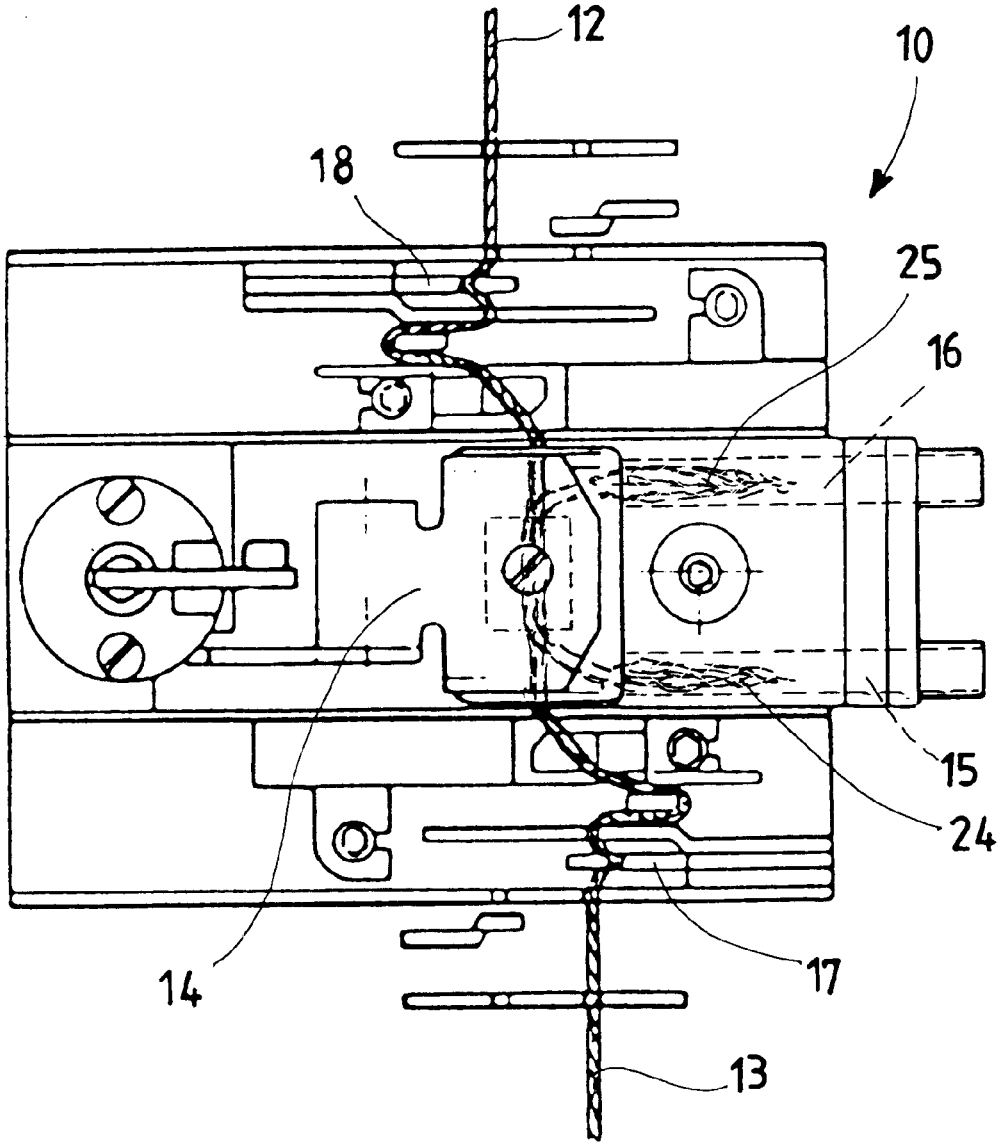
FIG. 5 is a schematic view of a suction stage of the ends in the splicing device in FIG. 1.

At this stage, the cover 14 is closed and the ends 24 and 25 are still sucked into the discharge channels 15 and 16 by the suction pressure maintained in it, as schematically illustrated in FIG. 5. Such suction is maintained until completion of the air and liquid jet in the mixing chamber 11.

To achieve such suction pressure, one possibility is to draw the suction pressure directly from the spooler suction.

A second possibility is to use an injector which creates pressure after the duct and therefore suction pressure upstream of it.

Figure 6:
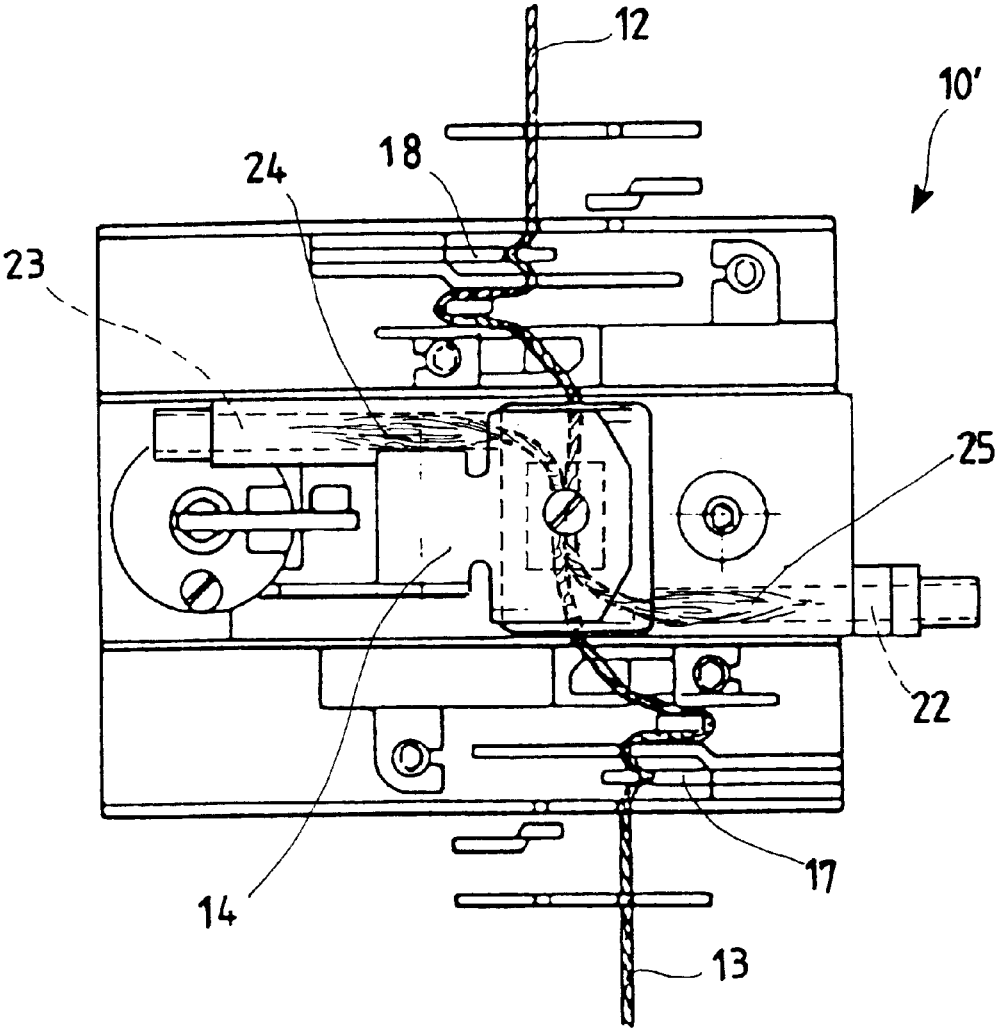
FIG. 6 is a schematic view of a suction stage of the ends in a second preferred variant of the present invention.

Another preferred variant of the present invention is shown, as a whole, by reference number 10' in FIG. 6.

In such device 10', the water discharge channels from tank 26 are shown by reference numbers 22 and 23 and are set on opposite sides of the tank 26.

Also in this case, suction pressure is previously created in the water discharge channels 22 and 23 from the tank 26 upon the hermetic sealing of the tank 26 until completion of the air and liquid jet in the mixing chamber 11.

Another variant of the present invention envisages that the treatment (detwisting) nozzles are set inside the tank 26 and that they also serve as water discharge ducts, but, anyway, that the same are put under suction pressure at least for the time required.

A further variant of the present invention provides that both the treatment nozzles and the discharge duct or ducts are set inside the tank 26, the ducts, in any case, being put under suction pressure as above.

Moreover, the object of the present invention is a process for splicing threads using compressed air and liquid.

This process provides a stage in which the threads to be spliced 12 and 13 are introduced into the splicing device 10 (or 10'), a clamping stage and thread cutting stage by means of the clamps 17 and 18 and scissors 19 and 20, a detwisting stage of ends 24 and 25 of threads 12 and 13 and a partial withdrawal stage of ends 24 and 25.

Lastly, the process has a stage in which the water discharge channels 15 and 16 (or 22, 23) of tank 26 are previously put under suction pressure upon the hermetic sealing of the tank 26 and until completion of the air and liquid jet in the mixing chamber 11 which carries out the splicing of threads 12 and 13.

The description makes the device and process characteristics clear for the splicing of textile threads, using compressed air and liquid which is the object of the present invention, with its advantages being likewise apparent.

The device allows the suction of thread ends which have already been cut and subjected to the detwisting stage inside the tank. This prevents the same being held back upon hermetic sealing, even if their length is greater than the tank width.

Another advantage of the device is that it gradually releases the ends during the splicing stage, without causing swirling damage, allowing a better splice formation and greater resistance. This improved splice formation also contributes to its improved aesthetic structure.

Besides, this reduces the pressure on the tank cover thus aiding the airtightness of the seal and preventing liquid leaking from the same.

Finally, as an additional desirable consequence, the chamber suction also allows the improved cleaning of the chamber itself, contributing to the removal of yarn residues or dust particles.

Finally, it is clear that numerous variations can be made to the device and process for the splicing of textile threads using compressed air and liquid, object of the present invention, without leading away from the innovative principles of the invention.

In the practical implementation of the invention, the materials, forms and dimensions of the details illustrated may be of any kind depending on the requirements, and that the same may be replaced with others technically equivalent.

What is claimed is:

1. A device (10, 10') for the splicing of textile threads using compressed air and liquid, comprising a casing having a splicing head in which is located a mixing chamber (11), said mixing chamber being capable of being hermetically sealed and having within said mixing chamber capable of receiving, discharging an splicing two threads or yarns (12, 13) within said mixing chamber (11), at least one feed duct for air with added liquid connected into said mixing chamber (11), said feed duct having a valve controlled by the emission of compressed air and a means to add liquid to the compressed air before emission of said compressed air into said mixing chamber (11), said splicing head with said mixing chamber being set in an isolated tank (26) from which extends at least one channel extending from said isolated tank for discharge to the outside of compressed air and any added liquid wherein said isolated tank has means for putting said at least one channel under suction.

2. A device (10) according to claim 1, wherein said at least one channel extending from said isolated tank for discharge to the outside of compressed air and any added liquid includes means for putting said channel under suction, said means comprising a tube which draws suction pressure directly from an aspirator of a machine to which said device is connected.

3. A device (10) according to claim 1, wherein the means for putting at least one channel for discharge to the outside of compressed air and any added liquid under suction comprises an injector which create suction pressure upstream from said at least one channel (15, 16, 22, 23).

4. A device (10) according to claim 1, wherein at least one channel (15, 16, 22, 23) extends from one side to the outside of said isolated tank (26).

5. A device (10) according to claim 1, wherein at least one channel (15, 16, 22, 23) is located on an opposite side of said isolated tank (26).

6. A device (10) according to claim 1, said isolated tank (26) has at least one detwisting nozzle and that said detwisting nozzle is further capable of serving as at least one channel.

7. A device (10) according to claim 1, said isolated tank (26) has at least one detwisting nozzle and that said detwisting nozzle is further capable of serving as at least one channel (15, 16, 22, 23).

8. A process for splicing of textile threads, comprising the steps of:

(a) introducing threads (12, 13) which have ends, into a splicing device;

(b) clamping and cutting the threads (12, 13);

(c) treating the ends of the aforesaid threads (12, 13), with air and liquid;

(d) partially withdrawing the ends of the threads (24, 25) through a discharge channel;

(e) creating suction pressure to move air and liquid from said discharge channel (15, 16) which extends from a hernetically sealed tank (26), until the splicing og threads (12, 13) is complete.

* * * * *